US007614716B2

(12) United States Patent
Higashiyama

(10) Patent No.: US 7,614,716 B2
(45) Date of Patent: Nov. 10, 2009

(54) APPARATUS DISCRIMINATING TYPE OF RECORDING MEDIUM AND METHOD OF DISCRIMINATING TYPE OF RECORDING MEDIUM

(75) Inventor: Taku Higashiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 667 days.

(21) Appl. No.: 11/013,847

(22) Filed: Dec. 16, 2004

(65) Prior Publication Data

US 2005/0134675 A1 Jun. 23, 2005

(30) Foreign Application Priority Data

Dec. 22, 2003 (JP) ..... 2003-424983

(51) Int. Cl.
*B41J 2/315* (2006.01)

(52) U.S. Cl. ..... 347/19; 374/45; 347/16; 347/221; 250/559.07; 250/486.1; 400/61; 358/3.2; 358/2.1; 369/53.22

(58) Field of Classification Search ..... 369/100, 369/53.22; 374/45; 250/559.07, 486.1; 347/221, 347/16, 19; 400/61; 358/3.2, 2.1
See application file for complete search history.

(56) References Cited

U.S. PATENT DOCUMENTS 4,644,163 A * 2/1987 Selander ..... 250/341.6
5,633,670 A * 5/1997 Kwak ..... 347/188
6,203,220 B1 * 3/2001 Takenoshita et al. ..... 400/61
6,291,829 B1 * 9/2001 Allen et al. ..... 250/559.07
6,425,650 B1 * 7/2002 Walker et al. ..... 347/14
6,449,232 B1 * 9/2002 Kuwahara et al. ..... 369/53.23
6,606,107 B2 * 8/2003 Minowa et al. ..... 347/193
6,726,357 B2 * 4/2004 Luque et al. ..... 374/45
6,863,363 B2 3/2005 Yabuta
6,868,052 B2 * 3/2005 Konno et al. ..... 369/53.23
7,055,929 B2 * 6/2006 Yabuta ..... 347/19
7,271,819 B2 * 9/2007 Matsutani et al. ..... 347/196
2004/0169710 A1 * 9/2004 Ide et al. ..... 347/101
2005/0219305 A1 * 10/2005 Kikuchi et al. ..... 347/19
2008/0239910 A1 * 10/2008 Kikuchi et al. ..... 369/53.22

FOREIGN PATENT DOCUMENTS

JP 2003-279511 12/2003
JP 2003-344325 12/2003
WO 03-044509 5/2003

* cited by examiner

*Primary Examiner*—Wayne R Young
*Assistant Examiner*—Linh T Nguyen
(74) *Attorney, Agent, or Firm*—Canon USA Inc IP Div

(57) ABSTRACT

A method of discriminating a type of recording medium and a discriminating apparatus in which the type of recording medium is discriminated based on a temperature change of the recording medium when the recording medium is heated. A type of recording medium is discriminated based on a phase difference between a pulse signal input to a heating device and a pulse signal output by a detecting device detecting a temperature of a recording medium.

5 Claims, 8 Drawing Sheets

APPARATUS DISCRIMINATING TYPE OF RECORDING MEDIUM AND METHOD OF DISCRIMINATING TYPE OF RECORDING MEDIUM

BACKGROUND OF THE INVENTION

1. Field of the Invention

The present invention relates to a method of discriminating the type of recording medium and, more specifically, to a method of discriminating a recording medium associated with a recording system and the structure of the same.

2. Description of the Related Art

Various types of recording medium are used in a recording system as typified by a laser-beam printer or an inkjet printer, such as normal paper, glossy paper, coated paper, or plastic film for an overhead projector (OHP). In order to record images of optimum quality for various types of recording medium, it is necessary to set various parameters, which correspond to the type of recording medium, to a printer when recording.

A case of an inkjet printer will be described for example. When normal paper and coated paper are compared, the coated paper can absorb and contain more ink than the normal paper. As such, the recording parameters are set to provide a larger amount of ink or a higher number of times of ink injection for the coated paper. It is because images can be formed in brighter colors on the recording medium by injecting a larger amount of ink. Since glossy paper used for recording picture-level images can absorb still larger amount of ink than the coated paper, the recording system can create an image with high level of quality with the settings for changing the overlapping ways of ink colors and the amount of ink injection (injection amount) or the number of times of ink injection.

The parameters which are changed according to the type of recording medium are generally set via a printer driver installed on a host computer based on the type of recording medium or a recording mode (recording quality) specified by a user before recording. The printer driver generates recording data for enabling recording corresponding to the type of recording medium or the recording mode specified by the user. Then, the recording system forms an image of a recording quality specified by the user based on the generated recording data.

However, in a case where the user specifies a type of recording medium different from the actual type because he/she does not have knowledge of, or misjudges, the type of recording medium, the recording system performs recording corresponding to the type of recording medium specified by the user. Therefore, optimum recording corresponding to the recording medium is not achieved.

In order to solve the above-described problem, there is a method for discriminating the type of recording medium by irradiating light onto the recording medium and discriminating the type of recording medium according to differences in quantity of light reflected from the recording medium.

As shown in FIG. 10, Japanese Patent Laid-Open No. 2000-301805 (U.S. Pat. No. 6,291,826) discloses a method of determining the property of the surface and the precise structure of the medium based on the quantity of light reflected or transmitted when light is irradiated on the recording medium from one or more directions and, based on judged result, discriminating whether it is normal paper, coated paper, photographic paper, or transparent film (OHP plastic film).

In FIG. 10, reference numeral 1010 designates a recording medium, reference numerals 1012, 1014, 1016 designate light sources for irradiating light to the recording medium from different angles respectively, and reference numeral 1022 designates a sensor for receiving transmitted light or reflected light from the light irradiated from the light sources 1012, 1014, 1016.

However, in the method disclosed in Japanese Patent Laid-Open No. 2000-301805, it is necessary to provide the light sources for irradiating light respectively from different directions.

According to the structure disclosed in the above-described Patent Document, a light source which emits a visible light beam, such as a light-emitting diode, an incandescent lamp, a laser diode, a surface light-emitting diode, is employed. A photoelectric sensor such as a charge coupled device (CCD) or a complementary metal-oxide semiconductor (CMOS) is used as a sensor for receiving the transmitted light or the reflected light, in order to determine the difference in reflecting property on the surface of the recording medium and the precise structure on the surface of the recording medium, thereby the type of the recording medium can be discriminated. At this time, reflected light originating from the light source 1014 is detected via a low-resolution optical device system with a large depth of field for the normal paper, reflected light originating from the light source 1016 is detected by a high magnification for the photographic paper, reflected light originating from the light source 1014 is detected by a magnification at a certain level, and transmitted light originating from the light source 1012 is detected for the OHP plastic film.

In this manner, in order to discriminate the various types of recording medium, an apparatus having a complex structure which includes a mechanism for changing the incident angle of the light sources and changing the detection magnifications of the reflected light and the transmitted light is required.

Moreover, since the reflecting properties of normal paper and coated paper are similar, there is a risk of misdiscrimination. However, in the inkjet printer, since the recording method (parameters to be set when recording) is different between the normal paper and the coated paper, it is desirable that such discrimination is performed accurately also between the normal paper and the coated paper.

SUMMARY OF THE INVENTION

The present invention is directed to a discriminating apparatus and a discriminating method that is capable of discriminating a type of recording medium accurately in a simple structure. More specifically, the present invention performs discrimination between normal paper and coated paper with high level of precision.

In one aspect of the present invention, a discriminating apparatus operable to discriminate a type of recording medium includes: a heating device configured to heat the recording media, a detecting device detecting thermal conductivity of the recording media heated by the heating device; and a discriminating device discriminating the type of the recording medium based on the thermal conductivity of the recording medium detected by the detecting device.

In another aspect, a discriminating apparatus operable to discriminate a type of recording medium includes: an irradiating device configured to irradiate light to the recording medium, a detecting device detecting thermal conductivity of the recording medium heated by the light irradiated by the irradiating device, and a discriminating apparatus discriminating the type of recording medium based on the thermal conductivity of the recording medium detected by the detecting device.

In yet another aspect, a method of discriminating a type of recording medium includes: a heating step of heating the recording medium, a detecting step of detecting thermal conductivity of the recording medium heated in the heating step, and an discriminating step of discriminating the type of recording medium based on the thermal conductivity of the recording medium detected in the detecting step.

In yet still another aspect, a method of discriminating a type of recording medium including: an irradiating step of irradiating light to the recording medium so as to heat the recording medium, a detecting step of detecting thermal conductivity of the recording medium heated by the light irradiated in the irradiating step, and an discriminating step for discriminating the type of the recording medium based on the thermal conductivity of the recording medium detected in the detecting step.

According to the present invention, discrimination of the type of recording medium utilizing the difference in values of thermophysical properties which are specific for the respective recording media is enabled. In particular, reliable and quick discrimination of the difference between normal paper and coated paper, which is highly demanded in printing operation using an inkjet printer, is achieved.

Further features and advantages of the present invention will become apparent from the following description of the embodiments with reference to the attached drawings.

DESCRIPTION OF THE EMBODIMENTS

First Embodiment

Figure 1:
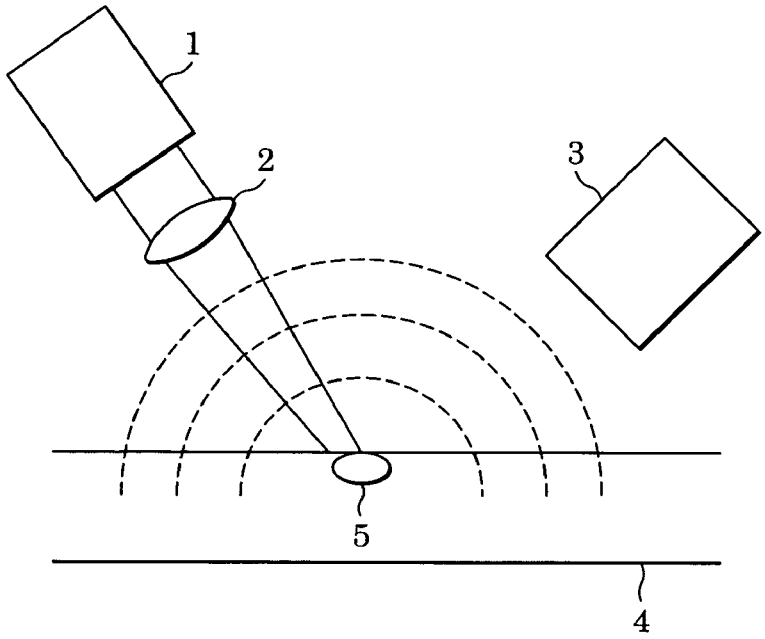
FIG. 1 is a block diagram of a discriminating apparatus for discriminating the type of recording media according to a first embodiment.

FIG. 1 is a block diagram of a discriminating apparatus for discriminating the type of recording medium according to a first embodiment of the invention.

Reference numeral 1 designates a heating device for heating a recording medium, reference numeral 2 designates a lens for condensing infrared rays from the heating device 1 onto the surface of the recording medium, reference numeral 3 designates an infrared ray detecting element for detecting infrared rays generating from a temperature-raising portion on the surface of the recording medium, and reference numeral 4 designates the recording medium. Reference numeral 5 designates a portion on the surface of the recording medium heated by the heating device 1 and the lens 2, thereby being raised in temperature. By using the lens 2, a part of the recording medium 4 (temperature-raising portion 5) can be heated intensively, so that a high rate of change in temperature of the recording medium is achieved.

The discriminating apparatus for discriminating the type of recording medium shown in FIG. 1 is provided in the transfer path before printing or in the recording medium stacking section, which is on the upstream side of the recording unit in the recording system in the direction of transferring the recording medium. The recording system includes a recording unit for forming an image on the recording medium, a control unit for transmitting to and receiving from a host computer via an interface and controlling an actuator such as a motor or recording unit in the recording system, and a circuit unit.

Figure 2:
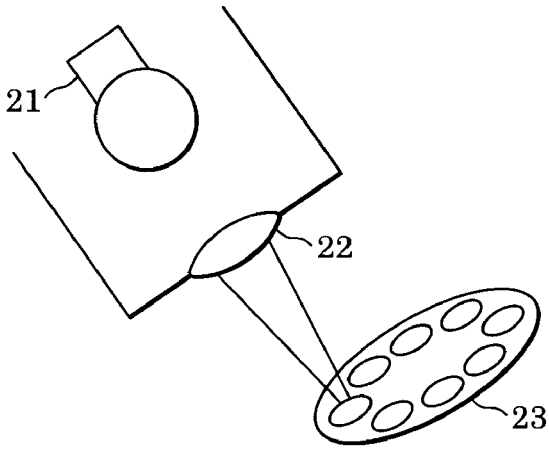
FIG. 2 is a block diagram showing a state in which an incandescent lamp, a condensing lens, and a chopper are used as a heating device.

The heating device 1 heats the surface of the recording medium 4 in pulses by alternately heating the recording medium and stopping the heating. A conceivable structure of the heating device 1, as shown in FIG. 2, includes an incandescent lamp 21, such as a tungsten lamp, a lens 22 for condensing infrared rays generated by the incandescent lamp 21, and a chopper 23 for generating pulsed infrared rays by interrupting the infrared rays condensed by the lens 22.

Figure 3:
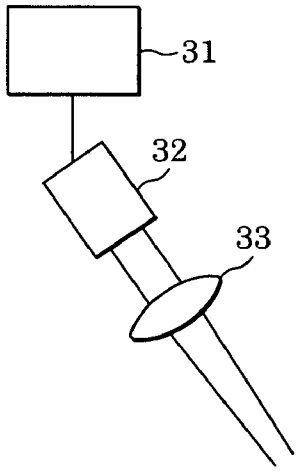
FIG. 3 is a block diagram showing a state in which a pulse generating circuit, a laser element, and the condensing lens are used as the heating device.

Alternatively, as shown in FIG. 3, a structure including a pulse generating device (circuit) 31 for applying pulsed current (intermittently), a laser element 32 for irradiating a laser beam, and a condensing lens 33. The laser element 32 can be a semiconductor infrared laser, such as a semiconductor infrared laser of InGaAsP system, PbSnTe system, or PbSnSe system. The range of oscillation wavelengths of the semiconductor infrared laser as described above is 0.8 to 40 μm, and the output is 30 to 50 mW at the highest. In the present embodiment, the heating device 1 employing a semiconductor infrared laser will be described. With the structure shown in FIG. 3, the heating device 1 can be downsized.

When the area of the temperature-raising portion 5 of the recording medium 4 heated by the heating device 1 is extensive, the rate of temperature drop of the recording medium 4 cannot be easily detected. Therefore, the infrared rays from the heating device 1 is condensed with the lens 2, so that the temperature-raising portion 5 is confined to a predetermined area like a spot. The infrared ray condensing lens 2 may be formed of quartz, fluorite, Ge, ZnSe, or Fresnel lens of polyethylene depending on the wavelength. It is also possible to condense light using a mirror of Al or Au. When the measuring field of the infrared ray detecting element 3 is narrow and hence a plurality of spot-shaped temperature-raising portions are necessary, the number of the heating device 1 (semiconductor infrared laser) and of the lenses 2 may be increased. Alternatively, by employing a lens having a plurality of condensing sections like a fly's eye as the lens 2, a plurality of temperature-raising portions 5 may be formed by one single heating device 1.

The infrared ray detecting sensor 3 can detect the change in temperature of the recording medium 4 without contact by detecting an infrared ray generated from the temperature-raising portion 5 on the surface of the recording medium. A temperature measuring method generally employed is a contact-type measurement such as a thermally sensitive resistor or a thermocouple. However, in the present invention, a non-contact type temperature measuring method can be employed in order to reduce the influence of contact resistance between the paper and the measuring instrument. Also, the wavelength of infrared rays to be detected is included within the range of the far infrared ray, since the wavelengths in the range from 3 to 5 μm and from 8 to 12 μm can hardly be absorbed in the atmosphere. However, when detecting the temperature at room temperature of 300 K (27° C.) using infrared ray, there exists background radiation of 300K. Therefore, when performing measurement, it is necessary to take into account noise caused by fluctuations of background radiation in the measuring system for wavelengths longer than 3 μm.

The infrared ray detecting element 3 can be broadly classified into a thermal type element having a wavelength-independent property and a quantum type element having a wavelength-dependent property.

The thermal type element is an element configured in such a manner that when infrared rays are irradiated, the temperature of the detector itself rises, and the effects (resistance, capacity, electromotive force, volume, spontaneous polarization) caused by the raise in temperature is converted into electrical signals. It has advantages in that the sensitivity is flat and is not highly selective for wavelengths, and the cost is low. It has disadvantages in that the sensitivity is lower than the quantum type, and the response speed is low.

The quantum type element can be classified into a type in which when infrared rays are irradiated on the semiconductor, electric conductivity varies according to free electrons or positive holes generated by photons, and a type in which an electro-motive force is generated when the photons are irradiated on the PN joint section of the semiconductor. The former is referred to as a "photo-conductive type", and the latter is referred to as a "photovoltaic type." The quantum type element has advantages in that it is highly sensitive, in that the response speed is high because variations in electro-conductivity or generation of the electro-motive force depend on absorption of the photons, which is time constant of several μs. Therefore, it is used as a detector for measuring transient phenomena or for measuring pattern. It has disadvantages in that the sensitivity is selective for wavelength, in that it is subjected to noise generated by fluctuations of the background radiation, whereby it is necessary to take a measurement for reducing the noise by cooling using liquid nitrogen or the like.

Although the quantum infrared ray detecting element provided with a cooling device or a HgCdTe infrared ray detecting element having a wavelength sensitivity to the extent of far infrared rays may be employed, considering the complexity or the cost of the apparatus, the infrared ray detecting element 3 of the thermal type is used in this embodiment.

Although the thermal type is inferior in sensitivity or response speed in comparison with the quantum type, this is not a problem because the thermal type has sufficient sensitivity for detection in this embodiment, and a response speed on the order of microseconds. The thermal type infrared ray detecting element includes a thermocouple-thermopile, a thermal detector, a pneumatic cell, and a pyroelectric element. Among these, the pyroelectric element can be operated at normal temperatures, has a flat spectral sensitivity characteristic, is cost-effective, has a long life, and has a higher sensitivity than other thermal elements. Furthermore, it provides output signals only when incoming energy is changed. From these reasons, the pyroelectric element is employed in this embodiment.

Subsequently, a structure in which the semiconductor infrared laser is employed in the heating device 1, and the pyroelectric element is used in the infrared ray detecting element 2 will be examined below.

The wavelength λ of the semiconductor infrared laser is from 0.8 to 40 μm. It is known that when the distribution of the strength of a laser beam is measured, it presents a Gauss distribution reducing exponentially from the center in the radial direction. When focusing the Gauss beam to obtain a thinner beam, the relational expression shown below is established.

[Expression 1]

$$d = \frac{K \cdot \lambda}{NA} \tag{1}$$

In the expression, d represents a focus diameter, K represents a coefficient determined in view of lens aberration and the influence of diffraction, which is generally about 0.8, and NA represents a numerical aperture of the used lens, which is from 0.5 to 0.6 for normally used lenses. Assuming that the output wavelength of the semiconductor laser is λ=0.8 μm, and NA of the lens is 0.5, which is a normal value, when the minimum value of the focus diameter d is calculated by the expression (1), d=1.3 μm is obtained. This value corresponds to the minimum value of the laser spot diameter (diameter of the temperature-raising portion 5) determined from the laser and the lens when the semiconductor laser is used.

On the other hand, when the laser beam is focused too much on the recording medium 4, the applied thermal flux is too strong, and the recording medium may ignite. How strong the thermal flux can be applied to the recording medium depends on the period of laser irradiation, the laser output, and the diameter of the laser spot. The general output of the semiconductor laser is 30 mW to 50 mW. The period of laser irradiation must be on the order of milliseconds when the pyroelectric sensor is used as the infrared ray detecting element, and it is determined to be 10 ms in view of pulsed repeated heating as in this embodiment. Using the ignition temperature of paper, 230° C., as the ignition temperature of the recording medium, the minimum diameter of the laser spot on the recording medium is examined. For this examination, using one dimensional thermal conduction in the direction of the depth of the recording medium, the thermal flux value which can be applied until the temperature of the surface of the recording medium reaches the ignition temperature was calculated, and assuming that the laser output value and the laser spot present a complete circle, the minimum laser spot diameter was obtained.

The relation among the surface thermal flux (q), the surface temperature difference (T), and the irradiation time (t) when a uniform thermal flux is applied on the entire surface of semi-infinite body can be expressed by the following expression.

[Expression 2]

$$q = \frac{\lambda \cdot T}{\sqrt{\pi \cdot \alpha \cdot t}} \tag{2}$$

In this expression, λ represents the coefficient of thermal conductivity of the recording medium, and α represents the thermal diffusivity of heat of the recording medium. When the laser output is represented by Q and the laser spot area is represented by S, the expression q=Q/S is satisfied.

When the thermal flux achieved when the surface of the recording medium reaches an ignition temperature of T=230° C. is calculated using the expression (2) assuming that the laser irradiation time is t=10 ms, and the values of thermophysical properties of the recording medium are $\lambda$=0.06 W/(m·K), $\alpha$=0.053 $mm^2/s$, which are the values for paper, $q=3.5\times10^5$ $W/m^2$ is obtained. Assuming that the output of the laser is Q=30 mW, the laser spot area $S=8.6\times10^{-2}$ $mm^2$ is obtained. Assuming that the laser spot is a complete circle, the diameter of the laser spot d=0.17 mm is obtained. This value is realizable because it is larger than the minimum value determined by the wavelength of the semiconductor infrared laser, which was obtained by the expression (1). Actually, since the laser beam irradiated on the recording medium goes into thermal diffusion three-dimensionally, it is possible to focus more than the diameter d which is obtained by the above-described calculation. However, the one dimensional calculation was performed as the most rigorous conditions to obtain the minimum laser spot diameter.

The operation of the discriminating apparatus for discriminating the type of recording medium will now be described.

1) Irradiation of Infrared Ray

Figure 4:
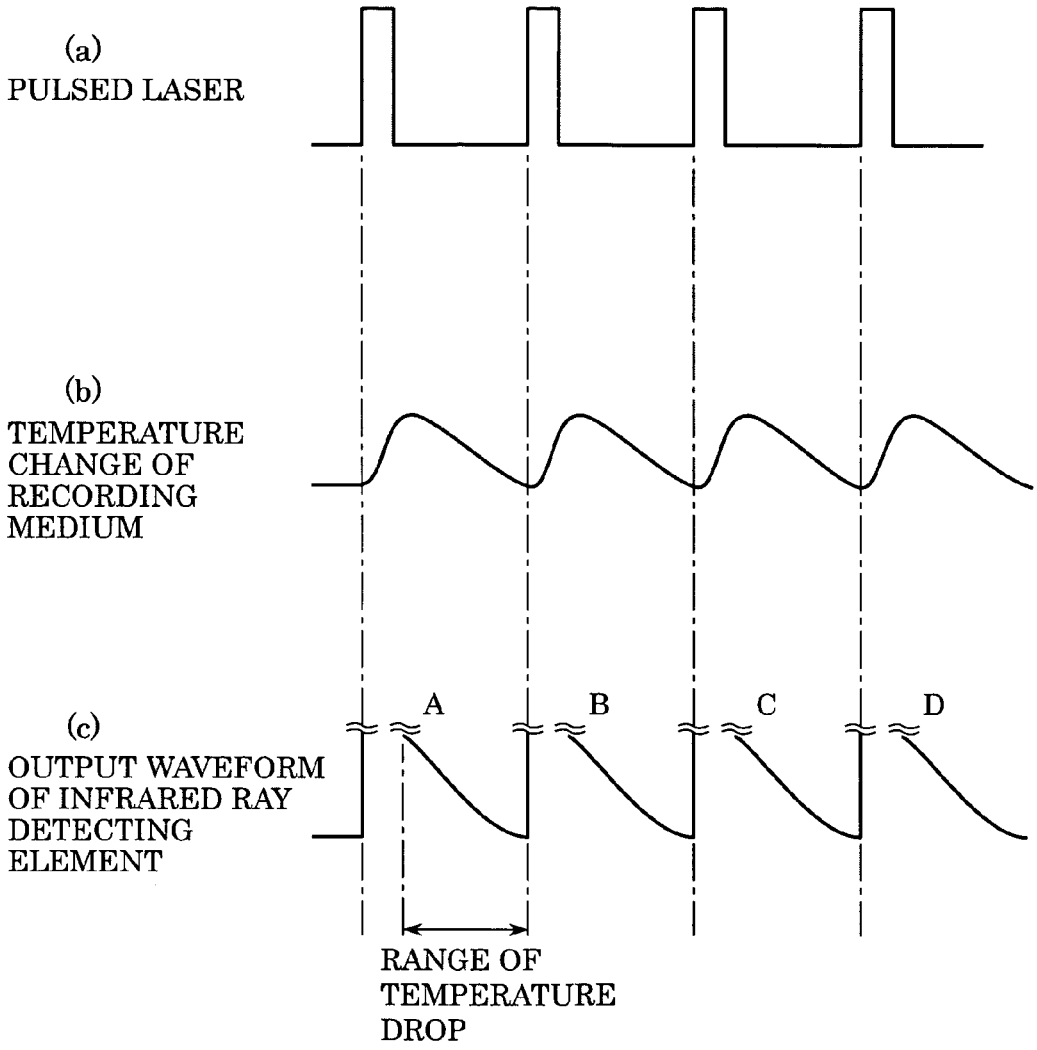
FIG. 4 is a drawing showing pulse signals to be applied to the heating device, the change in temperature of recording medium, and an output waveform from an infrared ray detecting element.

When a pulsed electric power to a semiconductor infrared laser is applied in a state in which the recording medium exists in the discriminating apparatus for discriminating the type of recording medium, a pulsed infrared ray as shown in FIG. 4A is irradiated on the recording medium. The irradiated infrared ray is condensed on the recording medium via the condensing lens, and the portion of the recording medium on which the infrared ray is irradiated rises in temperature according to the irradiation time. (See FIG. 4B)

2) Detection of Infrared Ray

The temperature-raising portion on the recording medium rises in temperature while the infrared ray is being irradiated because it receives energy. However, when the infrared ray is not irradiated, the heat runs through the recording medium and diffuses (FIG. 4B) and the temperature drops. With a series of temperature changes being repeated, the output of the infrared ray detecting element presents a pulsed waveform as shown in FIG. 4C. When the pyroelectric element is used as the infrared ray detecting element, the larger the magnitude of change in input value, the easier the detection becomes. Although the pyroelectric element also detects infrared rays from the semiconductor infrared laser at a moment when the semiconductor infrared laser is oscillated, it does not matter in the method of discriminating the type of recording medium according to the invention. It is because the infrared ray coming directly from the semiconductor infrared laser detected by the pyroelectric element will not be detected when oscillation of the semiconductor infrared laser is terminated. What is essential is to detect the portion with reduced signals which appears in the output pulse of the infrared ray detecting element (pyroelectric sensor) after that. Since the value of thermophysical property (thermal conductivity) of the recording medium differs depending on the type of the recording medium, the type of recording medium can be discriminated based on the portion with reduced signals detected after termination of oscillation of the infrared ray according to the values of thermophysical properties of the recording medium.

3) Discrimination of Type of Recording Medium

The output pulse waveform obtained from the infrared ray detecting element differs depending on the way of thermal transfer, which is specific for each type of recording medium as described above. In particular, the coefficient of thermal conductivity of generally used normal paper is 0.06 W/(m·K), whereas the coefficient of thermal conductivity of recording medium like coated paper fabricated by coating porous coating film on a base member is 0.2 W/(m·K) and the coefficient of thermal conductivity of recording medium fabricated by coating non-foaming coating film on a base member is 0.4 W/(m·K). This is due to the fact that metallic oxide having high coefficient of thermal conductivity such as alumina or silica is used as a coating film layer. As one of the values of thermophysical properties relating to the temperature change with time, there is thermal diffusivity. The thermal diffusivity is a value obtained by dividing coefficient of thermal conductivity by heat content. When the heat content is not significantly changed, the magnitude of the thermal diffusivity is proportional to the coefficient of thermal conductivity. Since the recording medium is thin, the heat content does not change significantly. Therefore, it is understood that the magnitude of the thermal diffusivity of the recording medium corresponds to the magnitude of the coefficient of thermal conductivity. The thermal diffusivity differs according to the type of recording medium, whereby the temperature change (rate of temperature drop) at the temperature-raising portion also differs. Accordingly, the type of recording medium is discriminated by detecting the temperature change at the temperature-raising portion, more specifically, the temperature change in the descending direction.

Since irradiation of infrared rays by the heating device 1 is performed a plurality of times in pulses, detection of the infrared ray by the infrared ray detecting element 3 (measurement of the temperature change on the surface of the recording medium) is also performed a plurality of times. As shown by A, B, C and D in FIG. 4C, the type of recording medium is discriminated by independently measuring the state of temperature drop (rate of temperature drop), calculating the average value of A to D, and comparing the obtained average rate of temperature drop and the rate of temperature drop obtained in advance and stored in a memory in the recording system. Alternatively, it is also possible to employ a configuration such that the type of recording medium is discriminated by the steps of adding the respective waveforms of A, B, C, and D in FIG. 4C so as to combine the same and then dividing the result by the number of waveforms to obtain an average, obtaining the rate of temperature drop of the averaged waveform, and comparing the obtained rate of temperature drop and the rate of temperature drop corresponding to the type of recording medium in the memory. According to the method of obtaining the rate of temperature drop from the averaged waveform, the influence of external noise caused by thermal noise can be reduced. This is because the external noise is generated at random and thus the portions with noise is compensated and reduced to the near-zero level by timewise averaging, but the waveforms of the cyclic signals such as the rates of the temperature drop shown by A-D in FIG. 4C do not change even after averaging with the same cycle.

With the method describe above, the infrared detecting sensor 3 can obtain the rate of temperature drop on the surface of the recording medium with high level of accuracy even when an infrared ray from the heating device 1 is also detected in addition to the infrared ray rising from the surface of the recording medium.

A control means (program) relating to the calculating process for discriminating the type of recording medium is stored in a storing device such as a memory in the recording system (NVRAM, etc.), and a central processing Unit (CPU, MPU) in the recording system discriminates the type of recording medium by the use of the discriminating apparatus for discriminating the type of recording medium by executing the program stored in the memory.

The control means (program) or the CPU for activating the discriminating apparatus for discriminating the type of recording medium for making the same discriminate the type of recording medium may be provided not in the recording system, but in an apparatus to be connected to the recording system via a parallel cable which is capable of two-way communication (for example, a host computer). In such a case, the parameters of the rate of temperature drop corresponding to the type of recording medium (or a table) is stored not in the memory in the recording system, but in the host computer, and the CPU of the host computer issues an instruction via a command for causing the discriminating apparatus for discriminating the type of recording medium provided in the recording system to execute the action of discriminating the recording medium. When the host computer receives the result detected by the discriminating apparatus for discriminating the type of recording medium from the recording system, the host computer discriminates the type of recording medium based on the received result, and a parameter (threshold) stored in the memory. It is also possible to store the threshold values in the memory as a table in which the types of recording medium are coordinated with threshold values. The host computer generates recording data coordinated with the discriminated type of recording medium and sends the same to the recording system, and the recording system forms an image based on the received data. When a program for causing an action for discriminating the type of recording medium or a coordinate table between the types of recording medium and the rates of temperature drop are stored in the memory of the host computer, even when a new type of recording medium having a different characteristic is put on sale, discrimination of the new type of recording medium can be discriminated by updating data in the memory. The updating can be performed simultaneously with the update of the printer driver installed in the host computer.

A structure may be such that the parameters of the rates of the temperature change corresponding to the types of recording medium (or a table) and the control device for discriminating the type of recording medium are provided in the recording system, so that the action of discriminating the type of recording medium is performed when a command for informing the type of recording medium is generated from the host computer, and then the discriminated type of recording medium is sent to the host computer. In this arrangement, the amount of data transmission between the recording system and the host computer can be reduced.

According to the present invention, the type of recording medium can be discriminated by detecting the temperature change on the surface of the recording medium when the recording medium is heated.

Second Embodiment

A second embodiment is different from the first embodiment in the position of arrangement of the infrared ray detecting element for detecting the infrared rays generated from the recording medium, and other structures are the same as those in the first embodiment.

Figure 5:
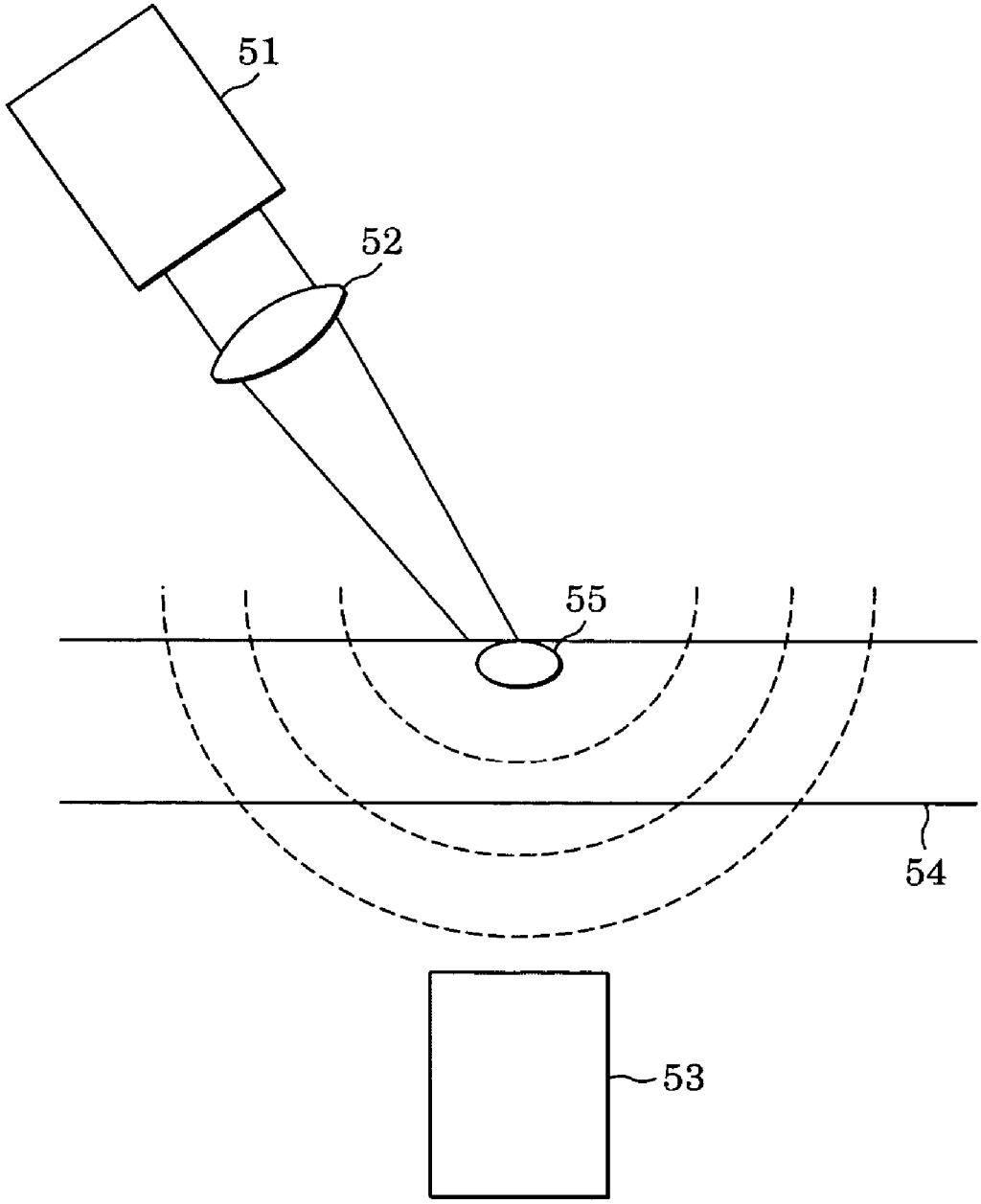
FIG. 5 is a block diagram of a discriminating apparatus for discriminating the type of recording medium according to a second embodiment.

FIG. 5 shows a block diagram of a discriminating apparatus for discriminating the type of recording medium according to the second embodiment.

Reference numeral 51 designates a heating device for heating the recording medium, reference numeral 52 designates a lens for condensing the infrared rays from the heating device 51 onto the surface of the recording medium, reference numeral 53 designates an infrared ray detecting element for detecting the infrared ray generated from the temperature-raising portion 55 on the surface of the recording medium, and reference numeral 54 designates the recording medium. Reference numeral 55 designates portions of the surface of the recording medium heated by the heating device 51 and the lens 52, thereby being raised in temperature.

The heating device 51 heats the recording medium 54 in pulses by repeating the heating and unheating process, and as in the first embodiment. The semiconductor infrared ray laser can be utilized. Also, in the present embodiment, since the recording medium 54 exists between the heating device 51 and the infrared ray detecting element 53, the recording medium can also be heated using a heat-generating resistance. In this manner, by interposing the recording medium between the heating device 51 and the infrared ray detecting element 53, the infrared ray detecting element 53 does not directly detect infrared ray emitted from the heated unit 51, and hence a number of types of elements can be employed as the infrared ray detecting element 53.

The action for discriminating the type of recording medium is almost the same as in the first embodiment.

Figure 6:
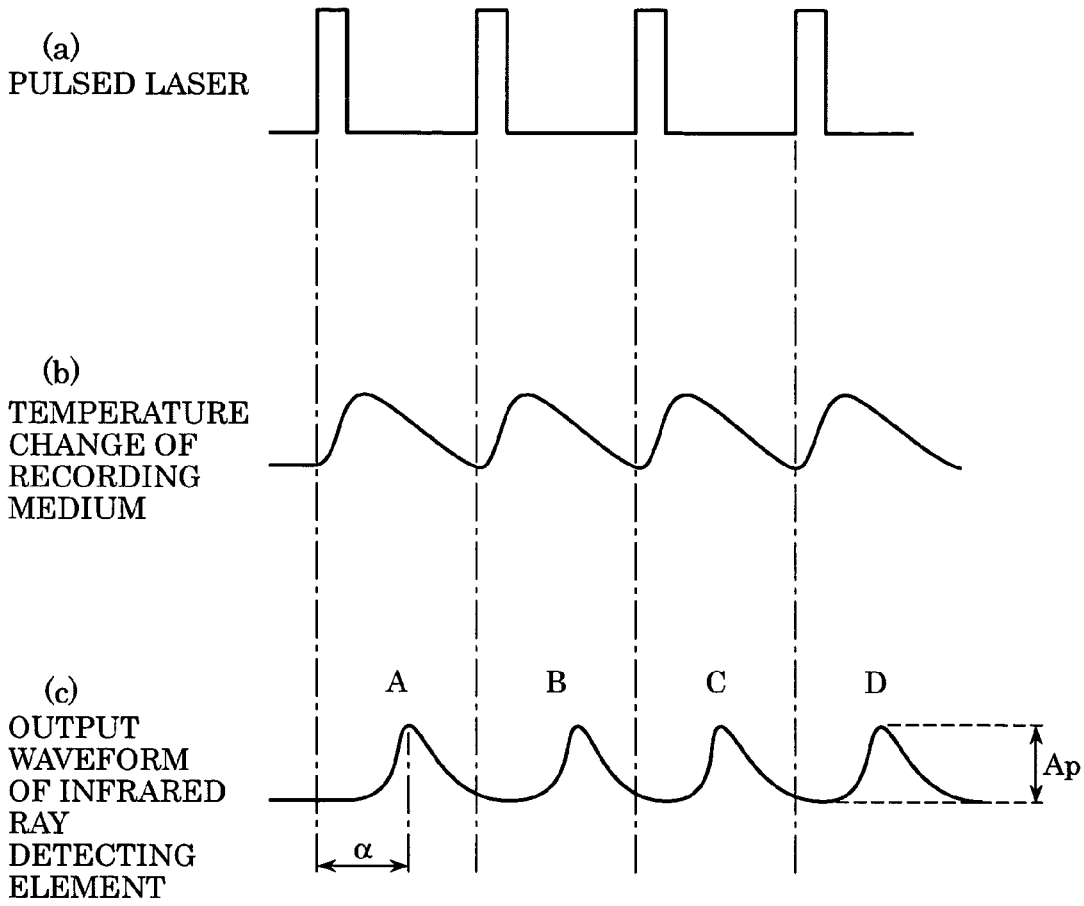
FIG. 6 is a drawing showing pulse signals to be applied to the heating device, the change in temperature of the recording medium and an output waveform from the infrared ray detecting element.

FIG. 6 is a graph of measurements of the temperature change of a recording medium according to the second embodiment.

First, an infrared ray is irradiated onto the recording medium 54 by the heating device 51. Then the temperature change on the recording medium is measured by detecting the infrared ray at the temperature-raising portion 55 on the surface of the recording medium by the infrared detecting element 53. As shown in FIG. 6C, when a pyroelectric element is used as the infrared ray detecting element 53, the larger the magnitude of change in input value, the easier the detection becomes. Subsequently, the type of recording medium is discriminated from the rate of temperature drop (temperature change) at the temperature-raising portion 55 on the recording medium measured by the infrared ray detecting element 53 and the rate of temperature drop corresponding to the type of recording medium which is obtained in advance.

In the present embodiment, since the recording medium 54 exists between the heating device 51 and the infrared ray detecting element 53 and since the infrared ray detecting element 53 does not detect the infrared ray irradiated from the heating device 51 directly, measurement of the temperature of the recording medium is performed without causing the output waveform of the infrared ray detecting element 53 to be scaled over.

It is also possible to discriminate the type of recording medium based on the relative relation between a reference signal generated in the discriminating apparatus for discriminating the recording medium and a signal detected by the infrared ray detecting element 53 when discriminating the type of recording medium. More specifically, by using the pulse signal to be applied to the heating device 51 and the waveform signal outputted from the infrared ray detecting element 53, the type of recording medium is discriminated by the relative relation (phase delay, amplitude) between the pulse signal and the waveform signal. The difference between the phase of the applied pulse signal and the phase of the output waveform outputted from the infrared ray detecting element 53 (hereinafter, referred to as phase difference $\alpha$), and the amplitude Ap of the output waveform outputted from the infrared ray detecting element 53 are used for discrimination of the type of recording medium.

In this manner, by using the phase difference $\alpha$between the pulse signal and the output waveform and the amplitude Ap of the output waveform, even when the infrared ray detecting element 53 detects not only the infrared ray from the temperature-raising portion 55 on the recording medium but also the infrared ray irradiated by the heating device 51, the rate of temperature drop of the recording medium can be detected with high level of accuracy. In addition, by using the phase difference $\alpha$ and the amplitude Ap, the influence of thermal noise caused by the peripheral temperature can be minimized.

The type of recording medium can be discriminated by comparing the characteristics of the recording medium detected by the infrared ray detecting element 53 and characteristics of the various types of recording media obtained by experiment or the like in advance and stored in the memory in the recording system.

According to the present embodiment, since the infrared ray detecting element detects only the infrared ray radiated from the temperature-raising portion of the recording medium, but not detecting the infrared ray radiated from the heating element, a detected value with less noises can be obtained from the recording medium detecting element, whereby the type of recording medium can be discriminated with a high degree of accuracy.

Third Embodiment

The present invention is characterized in that the recording media having similar reflecting properties (for example, normal paper and coated paper for inkjet printer) can be discriminated with high degree of accuracy. However, in a third embodiment, a structure for detecting the reflecting property of the recording medium is added to the first embodiment in order to discriminate the type of recording medium. With the hybrid structure, discrimination of the type of recording medium can be performed quickly and reliably.

Figure 7:
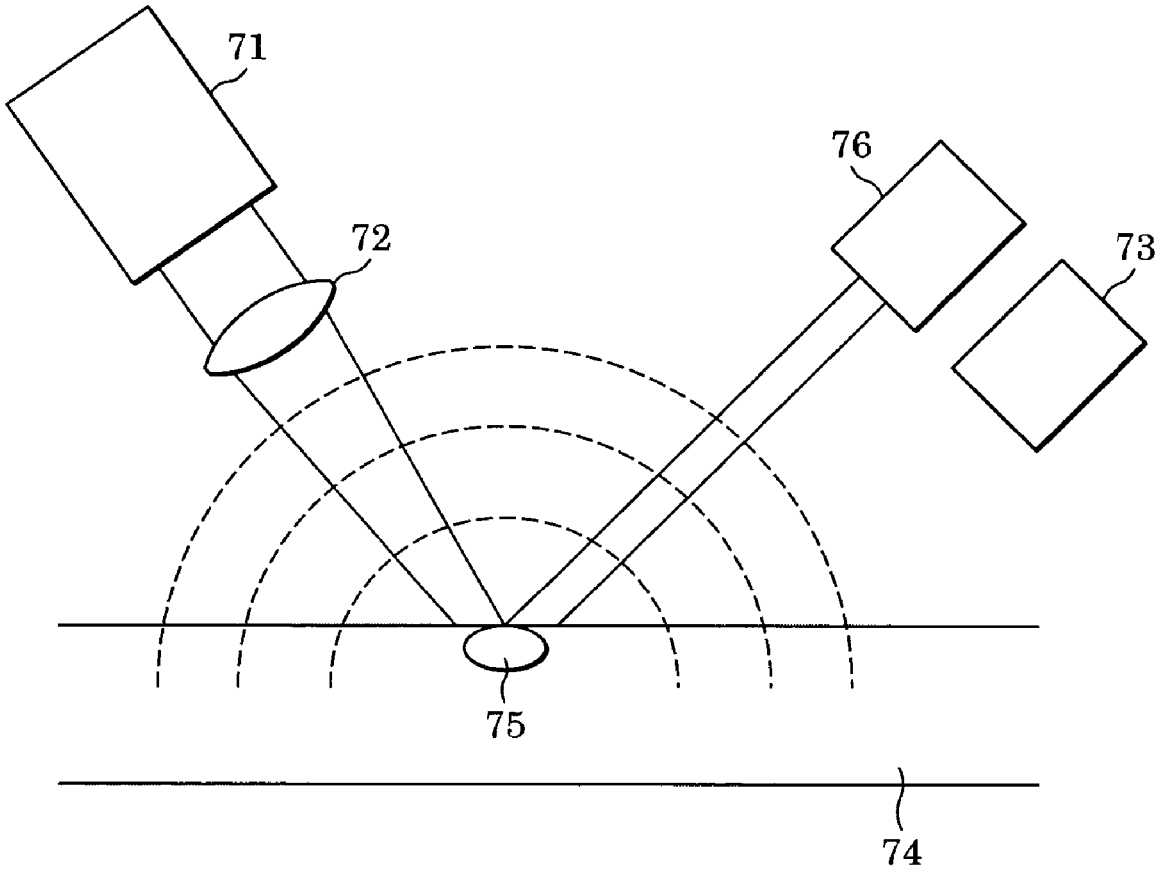
FIG. 7 is a block diagram of a discriminating apparatus for discriminating the type of recording medium according to a third embodiment.

FIG. 7 shows a block diagram of a recording medium discriminating apparatus according to the third embodiment.

Reference numeral 71 designates a visible light and infrared ray generating unit for heating the recording medium and generating visible light and infrared light for detecting the reflecting property of the recording medium, and reference numeral 72 designates a lens for condensing the visible light and the infrared light irradiated from the visible light and infrared light generating unit 71 on the recording medium. Reference numeral 73 designates an infrared ray detecting element for detecting the infrared ray generated from a temperature-raising portion 75 on the surface of the recording medium, reference numeral 74 designates a recording medium, reference numeral 75 designates a portion of the surface of the recording medium which is heated by the visible light and infrared light generating unit 71 and the lens 72 and hence increased in temperature. Reference numeral 76 designates a light receiving element for receiving visible light and infrared light generated by the generating unit 71, irradiated on the recording medium 74 and reflected off the surface of the recording medium 74.

The visible light and infrared light generating unit 71 according to the present embodiment repeats the heating and unheating process of the recording medium 74 by being driven in pulses, and irradiates visible light to the recording medium 74. As a device used for visible light and infrared ray generating unit 71 of the present embodiment, the combination of the incandescent lamp such as a tungsten lamp, a lens and a chopper as described in the first embodiment, or a combination of a device for supplying electric power in pulses, a laser element, and a condensing lens may also be employed. When using the laser element, the range of oscillation wavelength from the infrared range to the visible range can be selected. In particular, the infrared semiconductor laser having the structure such as InGaAsP system or GaInAlP system, and having the oscillation wavelength range from the visible range to the infrared range can be chosen. In the present embodiment, an example of a structure in which the semiconductor infrared laser is used as the visible light and infrared ray generating unit 71 may be described.

The lens 72 can be formed of quartz, diamond, or CaF2 which are not much absorbed in the range from the visible range (380 nm-780 nm) to the infrared range. The infrared ray detecting element 73 may be formed of elements described in the first embodiment.

Furthermore, the light receiving element 76 for receiving reflected light reflected from the surface of the recording medium and measuring the received amount of the reflected light may be a photoelectric image detecting element such as a CCD and a CMOS, a light detecting element such as a photodiode or a phototransistor, or a receiver having an amplifier integrated therein in addition to the light detecting element.

The relation between the types of recording medium and the reflecting properties will be described below.

Light reflecting from the surface of the recording medium like normal paper having an irregular surface and little glossiness contains large component of scattered light (also referred to as diffused light), and less component of reflecting light slanted in a predetermined direction (hereinafter, referred to as regular reflection light). Coated paper having a glossy coated film layer has less irregularity on the surface of the recording medium, and tends to have more regular reflection light component than the scattered light component. Therefore, with the provision of the light receiving element 76 at the position where the characteristic reflection property of the respective recording media can be detected, discrimination between the normal paper and the coated paper can be made based on the received amount of reflected light from the light receiving element 76. In the present embodiment, discrimination of the type of recording medium is performed based on the detection of one of the components of reflected light, regular reflection component or scattered reflection component, and the thermal conductivity of the recording medium.

Figure 8:
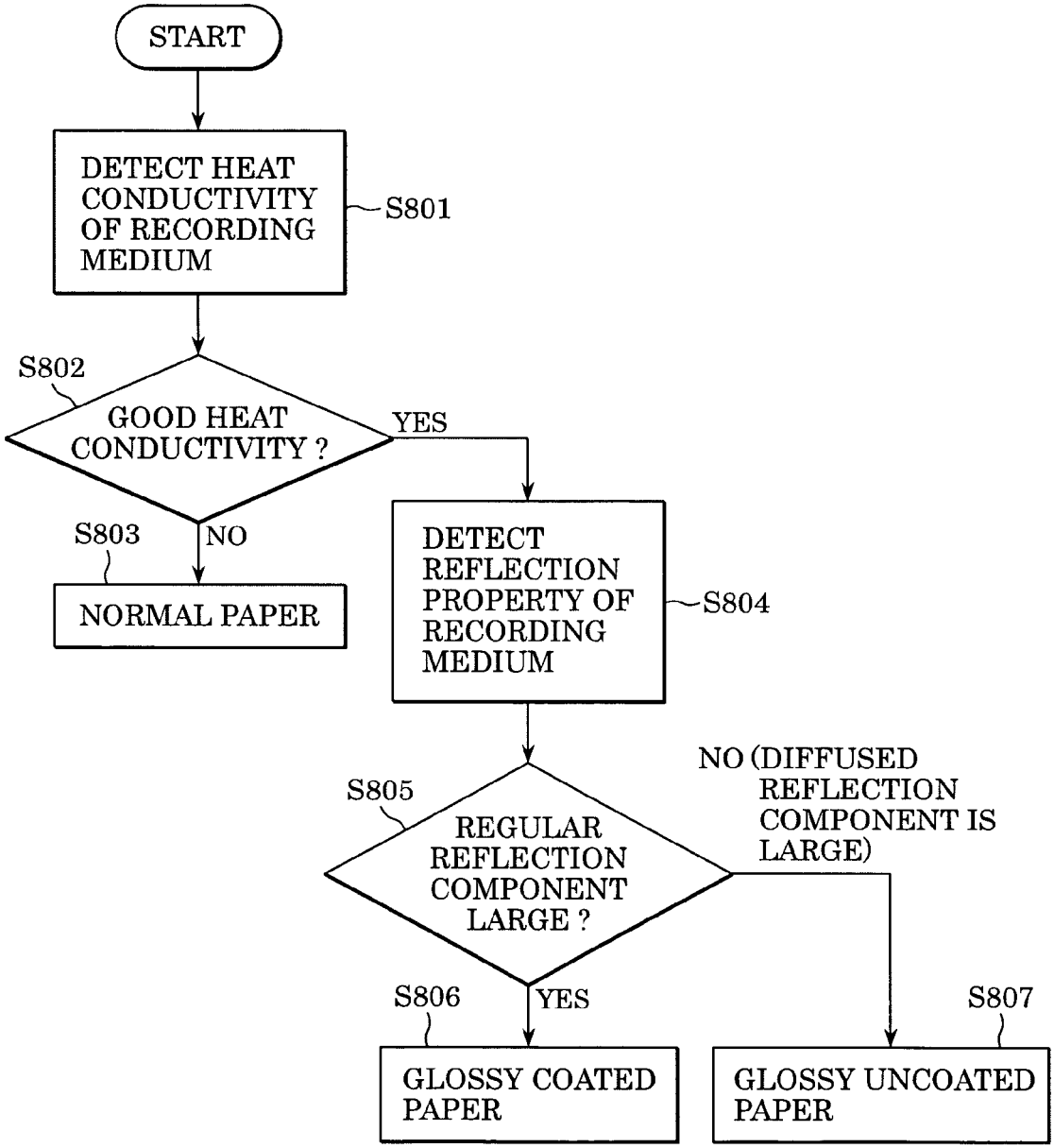
FIG. 8 is a flowchart showing a discriminating procedure for discriminating the type of recording medium.

FIG. 8 is a flowchart showing a discrimination procedure for discriminating glossy coated paper, non-glossy coated paper, and normal paper having similar values of thermophysical properties.

In Step 801, as in the case of the first and second embodiments, the thermal conductivity (rate of temperature drop) of the recording medium is measured. Subsequently, in Step 802, whether or not the measured heat conductivity is good is determined. If it is determined that the heat conductivity is not good, the procedure goes to Step 803, where the type of recording medium is judged to be normal paper.

In Step 802, if it is determined that the measured heat conductivity is good, the reflection property of the recording medium is detected in Step 804. More specifically, visible light is irradiated from the visible light and infrared ray generating unit 71 to the recording medium, and the amount of light reflected from the surface of the recording medium 74 is detected by the light receiving element 76. At this time, the reflected light component to be detected and measured may be any one of the regular reflection component and scattered reflection component. However, in this embodiment, the regular reflection component is employed. In Step 805, if it is determined that the detected regular reflection component is large, the procedure goes to Step 806, where the type of recording medium is judged to be glossy coated paper.

In Step 805, if it is determined that the detected regular reflection component is small, the procedure goes to Step 807, where the type of recording medium is judged to be non-glossy coated paper. The non-glossy coated paper has large scattered reflection component, whereby the detected regular reflection component is small.

In this manner, among the recording media having similar thermophysical properties, the type of recording medium can be accurately detected by measurement of thermophysical properties and reflected light from the surface of the recording medium.

In the discriminating procedure shown in FIG. 8, the thermophysical properties are measured first, and then the reflection properties of the recording medium are measured. However, the procedure in the reverse order is also applicable.

Also, since the infrared ray detecting element 73 has high flexibility in the angle of measuring field, the infrared detecting element 73 may be installed integrally with the light receiving element 76.

Furthermore, by using the infrared ray detecting element of the photo-electromotive type having sensitivity for wavelengths ranging from 0.7-1.7 μm for the infrared ray detecting element 73, both the infrared ray and the reflected light can be detected though consideration of wavelength selectiveness or cooling down of the element is required, the structure of the detecting element for detecting the type of recording medium can be simplified.

In the present embodiment, discrimination is performed only for normal paper, glossy coated paper, and non-glossy coated paper. However, by detecting the reflection properties of the recording medium in conjunction with measurement of the coefficient of thermal conductivity, various types of recording media such as glossy paper or OHP paper can also be discriminated.

Another Embodiment

Figure 9:
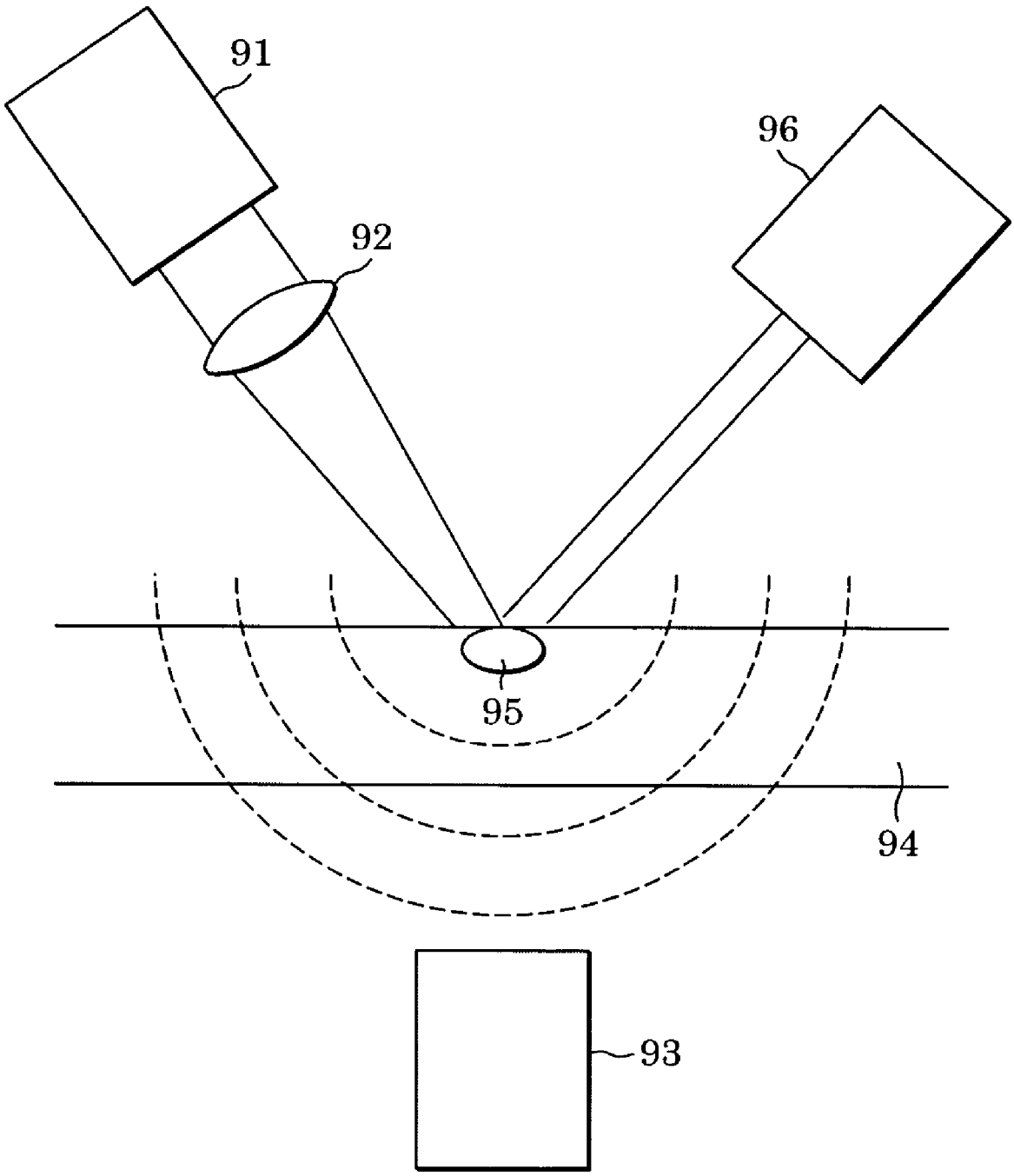
FIG. 9 is a block diagram of a discriminating apparatus for discriminating the type of recording medium according to another embodiment.
Figure 10:
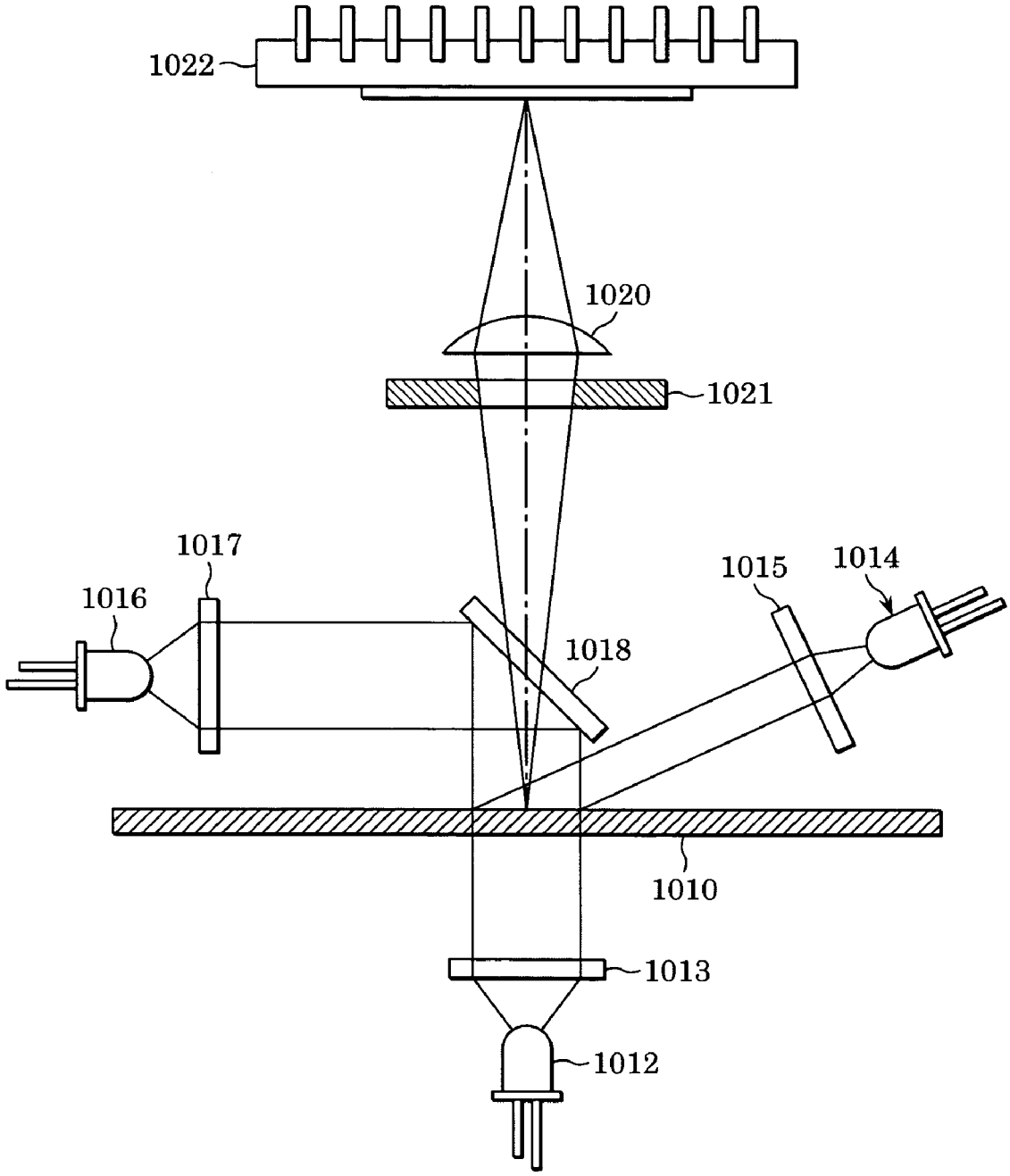
FIG. 10 PRIOR ART
FIG. 10 is a drawing showing a related art.

As shown in FIG. 9, it is also possible to interpose the recording medium 94 between the infrared ray detecting element 93 and visible light and infrared ray generating unit 91 in the structure according to the third embodiment in the same manner as in the second embodiment.

In this embodiment as well, since the reflection properties of the recording media in conjunction with measurement of the coefficient of thermal conductivity, various types of recording media can be discriminated. Furthermore, since the infrared ray generated from the heated portion 95 is not detected by the infrared ray detecting element 93 when measuring the thermophysical property in this structure, accuracy of detection of the values of thermophysical properties is improved.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-424983 filed Dec. 22, 2003, which is hereby incorporated by reference herein.

What is claimed is:

1. A discriminating apparatus operable to discriminate a type of recording sheet, comprising:

an irradiating device configured to irradiate light to a predetermined area of the recording sheet based on an input first pulse signal;

a detecting device detecting a temperature of the predetermined area of the recording sheet simultaneously with irradiating of light by the irradiating device, and outputting the detected temperature as a second pulse signal; and a discriminating device discriminating the type of recording sheet based on the thermal conductivity of the recording sheet and an amount of reflected light, wherein the discriminating device obtains the thermal conductivity based on a phase difference between the first pulse signal and the second pulse signal and an amplitude of the second pulse signal, and wherein the discriminating device discriminates the recording sheet as a normal paper when the thermal conductivity is lower than a first value, discriminates the recording sheet as a glossy coated paper when the thermal conductivity is higher than the first value and the amount of reflected light is larger than a second value, and discriminates the recording sheet as a non-glossy coated paper when the thermal conductivity is higher than the first value and the amount of reflected light is smaller than the second value.

2. A discriminating apparatus according to claim 1, wherein the detecting device includes an infrared ray detecting element.

3. A discriminating apparatus according to claim 1, further comprising a recording device configured to record image data based on the type of recording sheet discriminated by the discriminating device.

4. A discriminating apparatus according to claim 1, wherein the discriminating device obtains a temperature change of the recording sheet as the thermal conductivity.

5. A discriminating apparatus according to claim 1, wherein the discriminating device obtains a rate of temperature drop of the recording sheet as the thermal conductivity.

* * * * *